United States Patent [19]

Akanuma

[11] Patent Number: 5,061,877

[45] Date of Patent: Oct. 29, 1991

[54] DISCHARGE TUBE CAPABLE OF STABLE VOLTAGE DISCHARGE

[75] Inventor: Teruhiko Akanuma, Tokyo, Japan

[73] Assignee: NEC Corporation, Japan

[21] Appl. No.: 444,449

[22] Filed: Nov. 30, 1989

[30] Foreign Application Priority Data

Nov. 30, 1988 [JP] Japan ..... 63-154938

[51] Int. Cl.[5] ..... H01J 17/04

[52] U.S. Cl. ..... 313/631; 313/621; 313/632; 313/356

[58] Field of Search ..... 313/621, 622, 631, 632, 313/356; 361/120; 337/28

[56] References Cited

U.S. PATENT DOCUMENTS

| | | | |
|---|---|---|---|
| 2,397,982 | 1/1942 | Salzberg | 250/27.5 |
| 2,417,061 | 12/1943 | Chilcot | 250/27.5 |
| 2,422,324 | 2/1944 | Watrous | 313/622 |
| 2,427,086 | 9/1945 | Arnott | 313/622 |
| 2,492,295 | 12/1947 | Knochel | 313/622 |
| 2,562,031 | 4/1950 | Gerber | 313/146 |

FOREIGN PATENT DOCUMENTS

| | | | |
|---|---|---|---|
| 457568 | 6/1949 | Canada | 313/622 |
| 2828409 | 1/1980 | Fed. Rep. of Germany | 313/631 |

*Primary Examiner*—Donald J. Yusko
*Assistant Examiner*—N. D. Patel
*Attorney, Agent, or Firm*—Laff, Whitesel, Conte & Saret

[57] ABSTRACT

An arc discharge device is formed by two electrodes which are hermetically sealed within a glass tube filled with an inert gas. One electrode is cup shaped, with an open end. The other electrode enters the open end and approaches the bottom of the cup shape. The distance are such that the arc discharge occurs between the bottom of the cup and the end of the other electrode. The side wall of the cup shields the arc.

1 Claim, 3 Drawing Sheets

DISCHARGE TUBE CAPABLE OF STABLE VOLTAGE DISCHARGE

BACKGROUND OF THE INVENTION

1. Field of the Invention

This invention relates to an electrode structure in a discharge tube having opposing electrodes which are sealed in a housing.

2. Description of the Prior Art

A discharge tube having two electrodes opposed to each other within a hermetically sealed housing is popularly known and used as an electric part for providing a certain voltage.

A prior art discharge tube is now described referring to FIG. 1. As shown in FIG. 1, a discharge tube generally includes a hermetically sealed housing 103, a pair of electrodes 101, 102 which are opposed to each other within the hermetically sealed housing 103. An inert gas 105 is sealed in the space within the hermetically sealed housing 103. When a high electric voltage is applied to the electrodes 101, 102, a spark discharge X occurs between the opposing and portions 101*a* and 102*a* of the electrodes 101 and 102. Most of the prior art discharge tubes have electrodes formed in a simple rod shape as shown in FIG 1. The ends of the opposing portions 101*a* and 102*a* are exposed to the inner walls of the housing 103.

When spark discharge occurs repeatedly in the prior art discharge tube, electrode material is evaporated by the sparks scatters around the electrodes 101 and 102 and to adhere to the inner walls of the housing 103. As a result, the electrode material is spattered to form a film 106 throughout the entire surface of the inner walls of the housing 103. Since the film 106 is electrically conductive, there is a so-called creeping discharge Y or the discharge between the electrodes 101 and 102 which takes place via the film 106 takes place. Such a creeping discharge lowers the discharge starting voltage and makes the discharge operation unstable. It is therefore impossible to obtain a predetermined level of voltage.

SUMMARY OF THE INVENTION

An object of this invention is to eliminate such defects which are encountered in the prior art discharge tubes and to provide a discharge tube in which a discharge starting voltage is stable over a longer time period.

In order to achieve the above stated object, the discharge tube of the invention comprises a tubular hermetically sealed housing. A first electrode is hermetically fixed to one end of the housing and is provided with a cylindrical portion within the housing. A second electrode is hermetically fixed to the other end of the housing and is opposed to the cylindrical portion of the first electrode in a manner which extends an end portion thereof into the inside of the cylindrical portion. An inert gas is sealed within the housing. A spark discharge occurs between the first and second electrodes and within the cylindrical portion due to the above-mentioned structural arrangement.

BRIEF DESCRIPTION OF THE DRAWINGS The above object and feature of this invention will become more apparent from the following detailed description when taken in conjunction with attached drawings.

FIG. 1 is a vertical cross-section to show a prior art discharge tube;

FIGS. 2 and 3, respectively, show the first embodiment of this invention in a vertical section and in a partially sectioned perspective;

FIG. 4 is a graph which shows the characteristics of the embodiment and a prior art tube, in discharge operation and discharge starting voltage relation; and FIGS. 5 to 6 show sectional views of the second to the third embodiments of this invention.

In the drawings, the same reference numerals denote the same structural elements.

DESCRIPTION OF THE PREFERRED EMBODIMENTS

Figure 2:
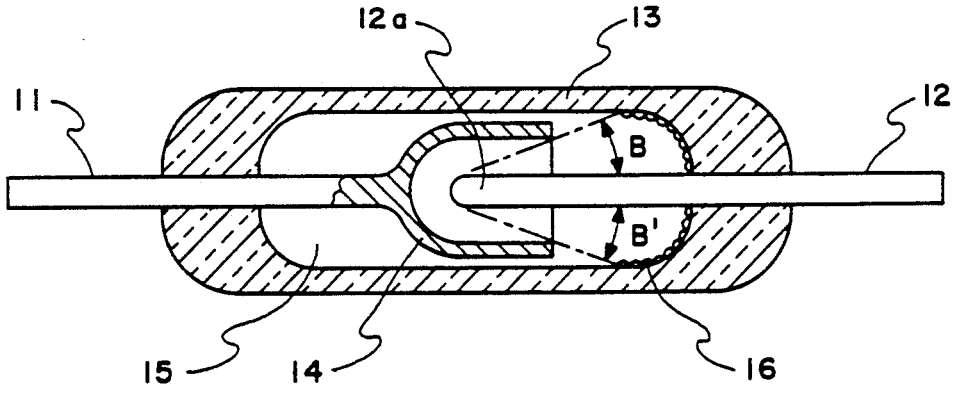
Figure 3:
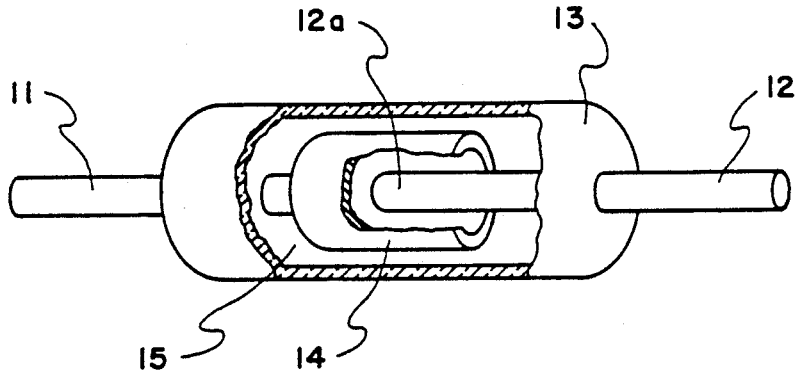

Referring now to FIGS. 2 and 3, an embodiment of this invention comprises a tubular hermetically sealed housing 13. A first electrode 11 which is hermetically fixed to one end of the housing 13, has a cylindrical spark shielding portion 14 on an end thereof. From an inspection of FIG. 2, it is apparent that enclosure 14 is cup shaped with a hemispherical bottom wall. A second electrode 12, which is hermetically fixed to the other end of the housing 13 and having an end 12*a* shaped in a semispherical form. An inert gas 15 is sealed within the housing 13. Two electrodes are disposed on the same axis and the electrode 12 is opposite to the electrode 11 in an end to end manner, with the end portion 12*a*, extending into the spark shielding portion 14.

In the discharge tube having the above structure, even if the electrodes are partially vaporized due to the high temperature caused by the spark discharge generated between the first electrode 11 and the second electrode 12. The spattered film 16 on the inner walls of the hermetically sealed housing 13 is limited to an area having the scope defined by the lines B, B', to prevent a creeping discharge.

Figure 1:
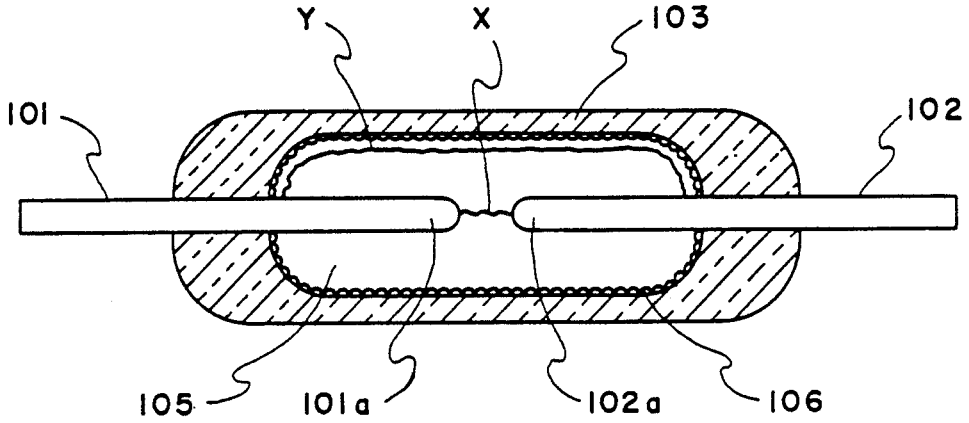
FIG. 1 (PRIOR ART)

More particularly, while the prior art discharge tube shown in FIG. 1 causes a creeping discharge after several million discharge operations, no creeping discharge is caused in the discharge tube shown in FIG. 2 even after several hundred millions of discharging operations, to thereby achieve a longer life for the discharge tube.

Figure 4:
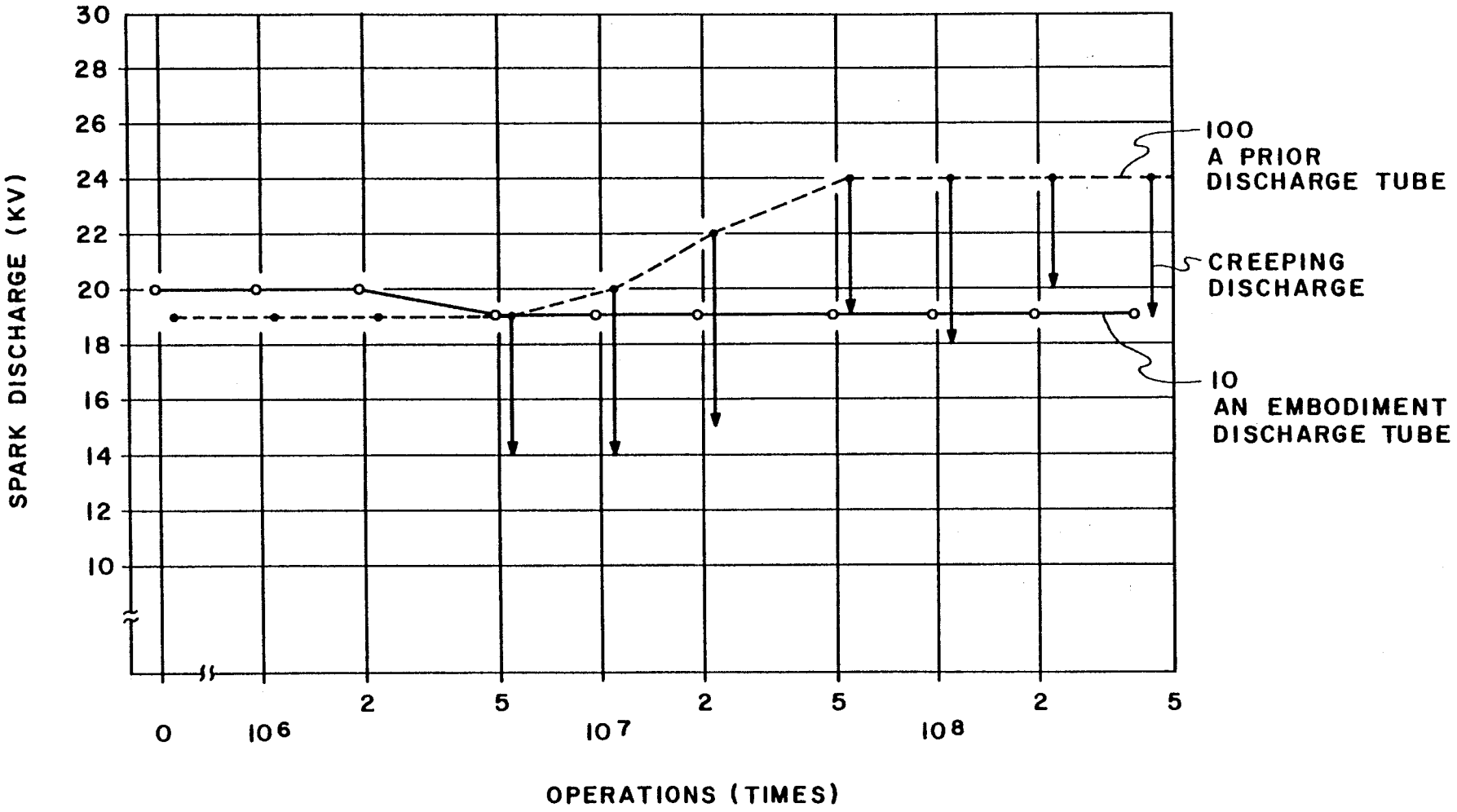

Specifically referring now to FIG. 4, in one embodiment, the electrodes 11 and 12 were made of an alloy of 48% Fe and 52% Ni. A discharge tube was made from the same material as electrodes 11 an 12, and with a minimum gap set at 3 millimeters. The change in the discharge starting voltage was measured in the tube, with the housing 13 made of lead glass and Kr (Kripton) gas of ca. 14 atm, used as the inert gas 15. The initial discharge starting voltage was set at ca. 20 kilovolts.

The prior art discharge tube of FIG. 1 showed a creeping discharge when the number of operations exceeded $5\times10^6$ as indicated with a broken line 100. The discharge starting voltage fluctuated unstably by 5 kilovolts. But, as shown with a solid line 10, this inventive discharge tube (FIGS. 2 and 3) did not show any fluctuations in the discharge starting voltage, due to the creeping discharge. The values of the starting voltage potentials stayed stable within a narrow scope.

It was also verified that, compared to the structure of FIG. 1, the embodiment of FIGS. 2 and 3 could maintain a discharge at a lower voltage. This is attributable to the fact that a diffusion of ion particles generated by the discharge between electrodes was inhibited by the shielding portion 14. This means that the power consumption required to continue the discharge could be reduced.

Figure 5:
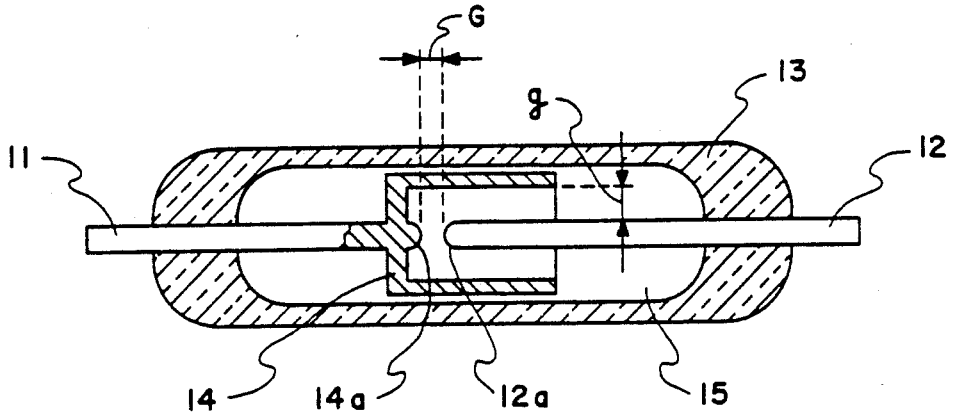

Referring to FIG. 5, the second embodiment of this invention will now be explained. In this embodiment, a small projection 14*a* is provided on the inner surface of the bottom of the shielding portion 14 of the electrode 11. The gap G between the projection 14*a* and the tip end 12*a* of the electrode 12 is made smaller than the minimal clearance g between the electrodes 11 and 12 at other locations. Due to such an arrangement, the spark discharges are concentrated at the portion which is around the projection 14*a*. As discharges take place constantly at the same position, the discharge starting voltage is further stabilized.

Figure 6:
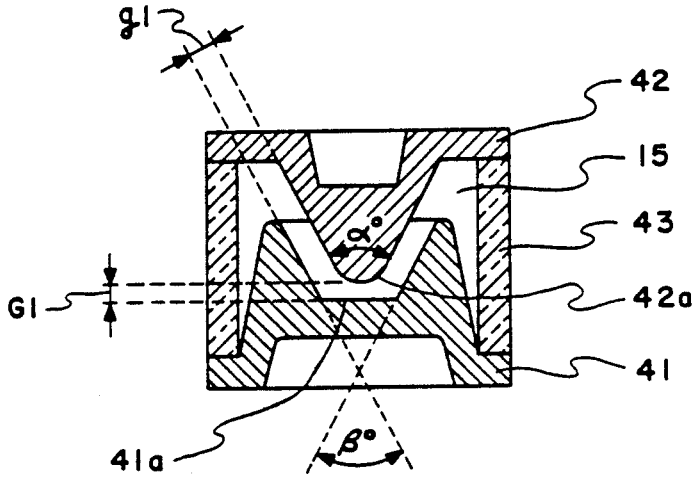

The third embodiment is shown in FIG. 6. This embodiment comprises a first electrode 41 formed in the shape of a funnel, and a second electrode 42 shaped like a cone. A cylindrical housing 43 is hermetically attached to the electrodes 41, 42 at openings on both sides of the housing. A gas fills the space 15 within the sealed housing. The electrode 41 is formed in a funnel shape with an apical angle of $\beta°$ while the electrode 42 has a cone shaped projection with an apical angle of $\alpha°$. The apical angle $\beta°$ is larger than or equal to the apical $\alpha°$ ($\alpha° \leqq \beta°$). The gap Gl between the inner surface bottom 41*a* of the electrode 41 and the tip end 42*a* of the projection of the electrode 42 is smaller than the clearance gl between the electrodes 41, 42 at other positions. The electrodes 41, 42 may be made of zirconium boride, and the housing 43 may be made of an alumina ceramic.

This embodiment of the discharge tube can be manufactured at a lower cost. More specifically, in the discharge tubes shown in FIGS. 1 to 5, as a cylindrical glass tube must be heated and hermetically closed while maintaining two opposed electrodes at a high positional precision. Therefore the manufacturing cost is high. However, as long as the dimensional precision of the electrodes 41 and 42 and the cylindrical housing 43 is maintained at a high level in the structure shown in FIG. 6, a discharge tube of any necessary length can be obtained simply by assembling the components. Thus the number of manufacturing steps can be reduced to thereby lower the manufacturing cost.

What is claimed is:

1. A discharge tube comprising:

a hermetically sealed tubular housing;

a first electrode having a cylindrical portion within said housing and being hermetically sealed to said housing at one end thereof;

a second electrode hermetically sealed to said housing at the other end thereof, said second electrode being disposed opposite to said first electrode so that an end portion thereof extends into an inside area of said cylindrical portion, said end portion and said inside portion being within said housing;

an inert gas sealed in said housing;

a projection on an inner face at the bottom of said cylindrical portion, the projection opposing said second electrode; and a first gap formed between said projection and said second electrode, the first gap having a minimal dimension as compared to the dimension of any other gap which appears between said first and second electrodes;

whereby any spark discharge between said first and second electrodes occurs at only said first gap.

* * * * *